United States Patent [19]

Paulson

[11] 4,193,591

[45] Mar. 18, 1980

[54] ADJUSTABLE BALL PROJECTING DEVICE

[76] Inventor: John K. Paulson, 14390 SW. Uplands Dr., Lake Oswego, Oreg. 97034

[21] Appl. No.: 904,872

[22] Filed: May 11, 1978

[51] Int. Cl.[2] ..... F41B 15/00

[52] U.S. Cl. ..... 272/78; 124/81; 124/82; 273/26 D

[58] Field of Search ..... 124/1, 6, 78, 41 R, 124/49, 50, 81, 82; 273/26 D

[56] References Cited

U.S. PATENT DOCUMENTS

| | | | |
|---|---|---|---|
| 3,724,437 | 4/1973 | Halstead | 124/78 |
| 3,734,075 | 5/1973 | Stadles | 124/49 X |
| 3,774,584 | 11/1973 | Paulson | 273/26 D X |
| 3,913,552 | 10/1975 | Yarur et al. | 124/50 |
| 4,026,261 | 5/1977 | Paulson et al. | 124/78 |
| 4,080,950 | 3/1978 | Paulson et al. | 124/1 |

*Primary Examiner*—William R. Browne
*Attorney, Agent, or Firm*—Oliver D. Olson

[57] ABSTRACT

One of a pair of laterally spaced ball projecting wheels is adjustable laterally with respect to the other for accommodating the projecting of balls of different diameters, and a ball feed chute associated with the wheels is formed in lateral segments one of which is movable laterally with the laterally adjustable wheel for varying the width of the feed chute to correspond with the spacing between the wheels.

5 Claims, 4 Drawing Figures

ADJUSTABLE BALL PROJECTING DEVICE

BACKGROUND OF THE INVENTION

This invention relates to ball throwing devices, and more particularly to such devices which are adjustable to accommodate the throwing of balls of different diameters.

Applicant's earlier U.S. Pat. No. 3,774,584 describes a ball throwing device in which a pair of rotary wheels are independently adjustable in speed to achieve the throwing of a ball with wide variations in velocity and curvature. However, the device is not adjustable to accommodate balls of different diameters and therefore a separate device is required for each different diameter ball. This requirement imposes a significant added cost for those, such as schools, who have need for such devices, for example, for batting and fielding practice and training both in baseball and in softball.

SUMMARY OF THE INVENTION

In its basic concept, the ball projecting device of this invention accommodates the simultaneous adjustment of the spacing between a pair of ball projecting wheels and the width of a ball infeed chute associated therewith.

It is by virtue of the foregoing basic concept that the principal objective of this invention is achieved; namely, to overcome the limitations of prior ball projecting devices.

Another objective of this invention is to provide a ball projecting device of the class described in which the simultaneous adjustment of the wheels and chute is accompanying by adjustment of the longitudinal center line of the chute to maintain its centered between the wheels.

A further object of this invention is the provision of a ball projecting device of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
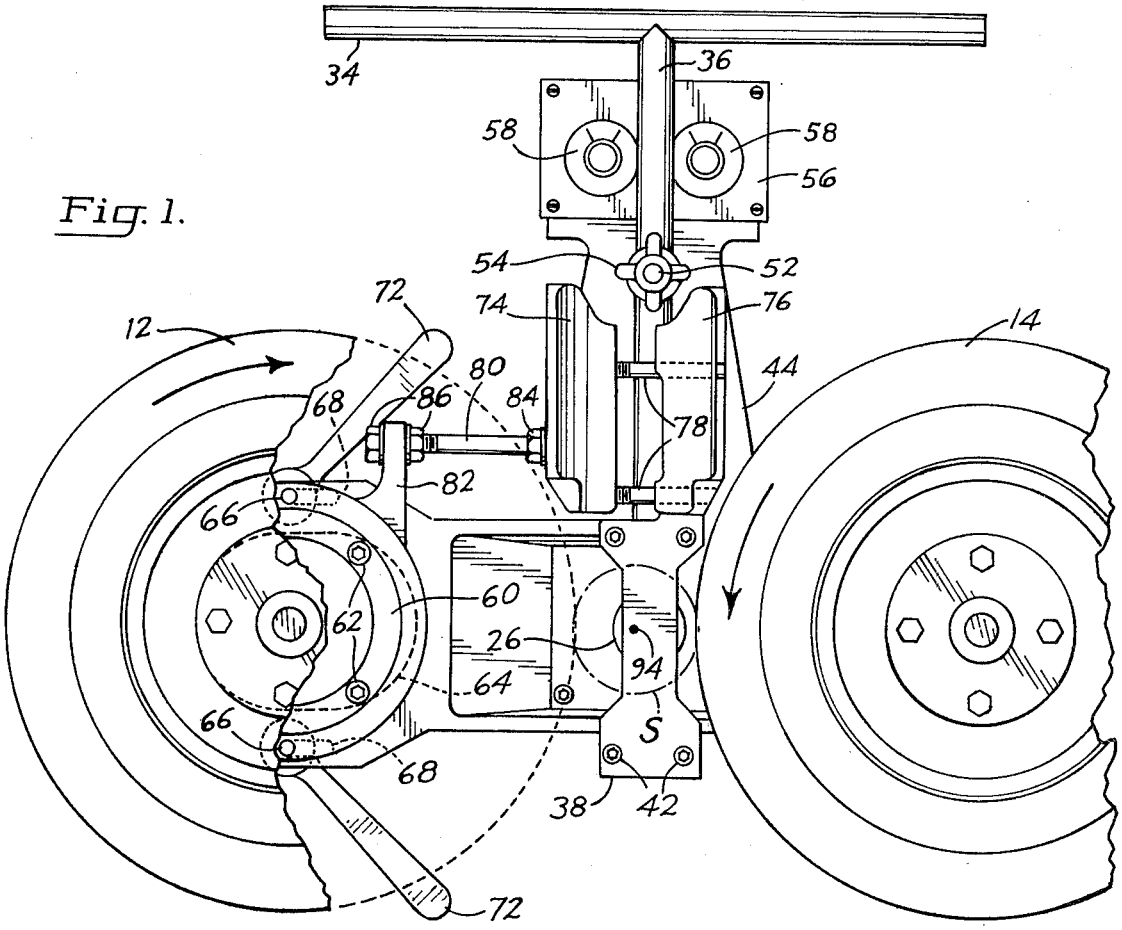
FIG. 1 is a fragmentary plan view, partially broken away, of a ball projecting device embodying the features of this invention, the components being adjusted to accommodate the projection, for example, of a softball.

The ball throwing device illustrated in the drawings is quite similar to the device illustrated in applicant's earlier patent referred to hereinbefore. Thus, it includes a base member 10 preferably in the form of a metal casting, for mounting a pair of spaced, rotary, ball projecting wheels 12 and 14. To this end, the base member includes a pair of laterally projecting arms 16 and 18 apertured adjacent their outer ends to receive the drive motors 20 and 22 vertically therethrough. The rotary output shafts of the motors mount the wheels for rotation in opposite directions, as indicated by the arrows in FIGS. 1 and 4, and in a substantially common plane 24.

The drive motors may be of the fluid pressure type or, preferably, of the electric type illustrated. Further, the motors preferably are of the variable speed type in order to adjust the rotational speed of each wheel independently of the other.

Universal mounting means is provided for supporting the base member and wheels for pivotal adjustment in all directions about a common pivot point spaced from the rotational plane 24 of the wheels. As explained in detail in applicant's earlier patent referred to hereinbefore, the base member is provided with a socket component 26, in the form of a spherical segment, of a ball and socket unit, for cooperative association with a ball component 28 mounted on a base support. The base support includes a body member 30 anchoring the upper ends of a plurality of downwardly diverging legs 32.

Means is provided for manually pivoting the base member and support wheels relative to the ball component 28. This means is provided in the embodiment illustrated by a T-shaped handle the cross member 34 of which provides hand grips and the longitudinal leg 36 of which is secured to the base member. This attachment is made by providing the confronting surfaces of the base member 10 and an overlying block 38 with registering angular grooves 40. These grooves form an elongated socket for the removable reception of the leg 36. Screws 42 extending through the overlying block and engaging threaded openings in the base member 10 serve to clamp the leg 36 to the base member.

Means also is provided for securing the ball and socket components in selected positions of adjustment. In manner similar to applicant's earlier patent, a clamping plate 44 is provided with an opening in the form of a spherical segment having a diameter less than the diameter of the ball. The plate also is provided with a longitudinal slot 46 extending forwardly from the opening and dimensioned to receive freely therethrough the upper reduced portion 30' of the body 30 for removable registration of the socket with the ball. The forwardly projecting portions of the plate, separated by the slot, are connected together by a transverse bar 48 and are also connected to the overlying, forwardly projecting portion of the base member, as by means of screws 50.

Adjacent the rearward end of the clamping plate 44 is an upstanding threaded screw 52 which extends freely through an opening in the central leg of the T-handle. An internally threaded clamp knob 54 is threaded onto the projecting upper end of the screw and its lower side bears against the handle leg 36. Accordingly, by appropriate hand rotation of the clamp knob the clamping plate 44 is moved closer to or farther from the base member 10, whereby to clamp the ball 28 releasably between the base member and clamping plate. By loosening the clamp knob the base member 10 and hence the rotational plane 24 of the wheels, may be pivoted about the center of the ball 28 in all angular directions.

The rearward end of the clamping plate 44 forms a mounting base for a control housing 56. This housing contains a pair of electrical controls one associated with each of the electric motors 20 and 22 and operable to vary the speed of the latter. A control knob 58 is provided for each control, as will be understood.

Applicant's earlier patent referred to hereinbefore also describes in detail the function of the universal mounting of the wheels and the speed adjustments of the wheels as providing a wide range of types, directions, curves and speeds of throws and pitches.

In accordance with this invention, means is provided for adjusting the device to accommodate the throwing of balls of different diameters, for example baseballs and the larger diameter softballs. In the embodiment illustrated, the assembly of right hand wheel 14 and drive motor 22 is secured in fixed position on the right hand arm, by motor collar 22' and attaching screws, so that it remains fixed relative to the handle clamp block 38. The assembly of the other wheels 12 and drive motor 20, the left one illustrated in the drawings, is attached to a slide plate 60, by means of motor collar 20' and attaching screws 62 (FIG. 1) extending through the motor collar into threaded openings in the slide plate. The corresponding left hand arm 16 is provided with a laterally elongated opening 64 dimensioned to freely receive the drive motor but not the slide plate. Thus, the drive motor and wheel assembly is adjustable laterally along the opening.

Means is provided for clamping the slide plate to the underlying support arm in any desired position of lateral adjustment. As illustrated, a pair of clamp screws 66 extend upwardly freely through laterally elongated slots 68 in the support arm and are threaded into threaded openings in the slide plate. The lower end of each clamp screw terminates in an enlarged clamp head 70. An operating handle 72 extends radially outward from the head to facilitate manual rotation of the screw between plate clamping and plate releasing positions.

As mentioned hereinbefore, lateral adjustment of the slide plate 60 and the associated wheel and drive motor assembly serves to vary the lateral spacing between the pair of wheels 12 and 14, to accommodate balls of different diameters. This lateral adjustment of one of the wheel assemblies is accompanied by simultaneous adjustment of the width of a ball infeed chute by which balls are delivered between the rotating wheels for projection therefrom.

In the embodiment illustrated, the ball infeed chute is formed as a pair of separate lateral segments 74 and 76. The right hand segment 76 illustrated in the drawings is formed integrally with or otherwise secured permanently to the handle clamp block 38, whereby it is retained in fixed position with the latter and with the right hand wheel assembly.

The opposite, left hand segment 74 of the feed chute is mounted for lateral movement with the slide plate 60. For this purpose a pair of shafts 78 are secured to the movable segment 74 and extends slidably through registering openings in the fixed segment 76, whereby to support and guide the movable segment through its range of lateral movement.

The movable segment is secured to the slide plate 60 by means of an elongated rod 80 secured at one end to the movable segment 74 of the chute and at the opposite end to a lug 82 projecting from the slide plate. As illustrated, the inner end of the rod is threaded into a threaded opening in the movable segment of the chute and secured therein by means of a lock nut 84. The opposite end portion of the rod is threaded and extends freely through an opening in the lug. A pair of adjustment nuts 86 on the threaded portion on opposite sides of the lug serve to adjust the spacing between the lug and movable segment of the chute. By this means the operating width of the chute is adjustable precisely in accordance with the corresponding spacing between the wheels 12 and 14.

Figure 2:
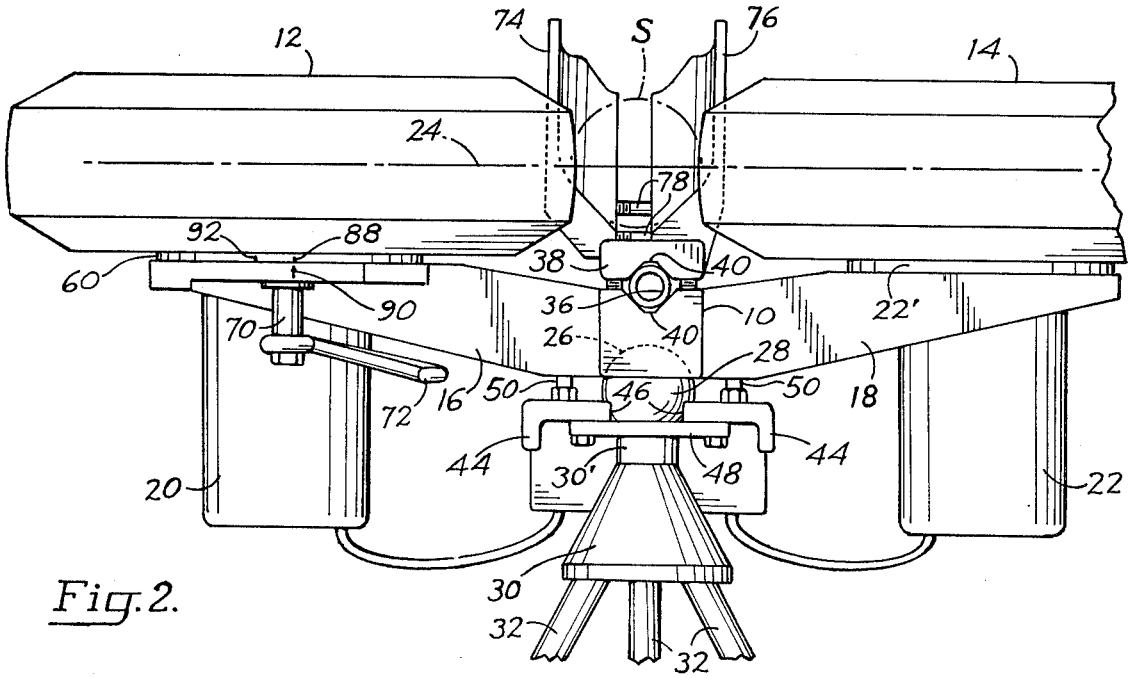
FIG. 2 is a fragmentary front elevation as viewed from the bottom in FIG. 1.
Figure 3:
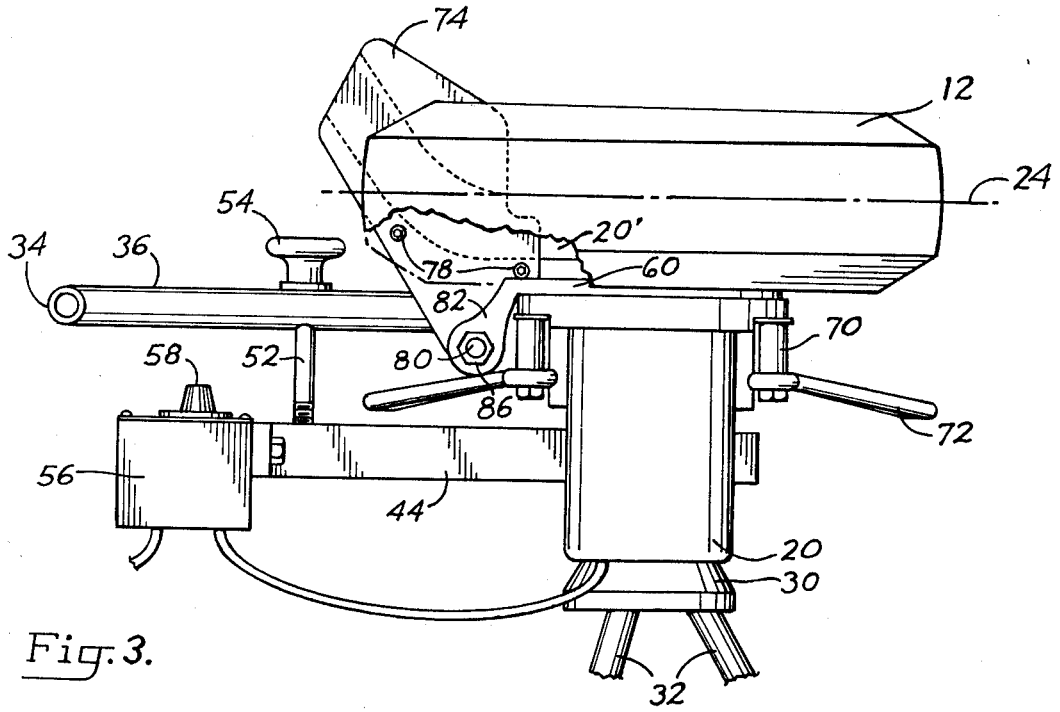
FIG. 3 is a fragmentary side elevation as viewed from the left in FIG. 1.

FIGS. 1 and 2 illustrate the ball projecting device of this invention in a position of adjustment wherein the wheels are moved apart an appropriate distance to accommodate the throwing of a softball S. In this position the clamp screws 66 abut the outer ends of the elongated guide slots 68. It will be understood, of course, that the guide slots may be longer than illustrated and that the adjustment may be determined by a scale marking 88 (FIG. 2) on the slide plate 60 registering with an index mark 90 on the base arm 16.

Figure 4:
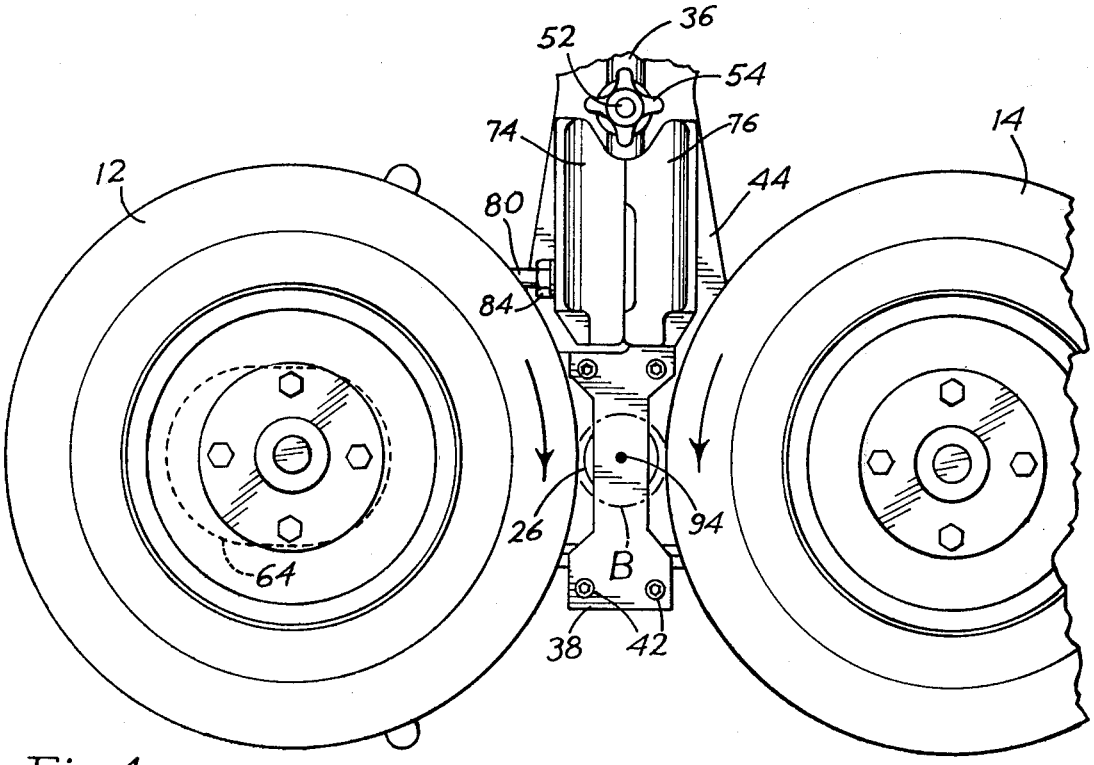
FIG. 4 is a fragmentary plan view, similar to FIG. 1, showing the components adjusted for projecting a ball, for example a baseball, of smaller diameter than the ball accommodated by the adjustment illustrated in FIG. 1.

In like manner, FIG. 4 illustrates the ball projecting device in the position of adjustment accommodating the throwing of a baseball B. This position of adjustment may be established either by the movable segment 74 of the chute being brought into abutment with the fixed segment 76, the clamp screws 66 being brought into abutment with the inner ends of the guide slots 68, or a scale marking 92 (FIG. 2) on the slide plate being brought into registry with the index mark 90.

It is to be noted that as the adjustable wheel assembly is moved laterally with respect to the fixed wheel, the mid-point of the minimum spacing between the wheels also moves laterally. Thus, in FIG. 1 the mid-point 94 is shown to be displaced toward the left of the longitudinal center line of the clamp block 38, whereas in FIG. 4 the mid-point 94 is shown to be substantially centered on the clamp block. It is important to note that during this lateral adjustment of the movable wheel assembly that the movable segment 74 of the ball feed chute also is adjusted laterally, simultaneously, to maintain the longitudinal center line of the feed chute in registry with said mid-point. By this means the balls delivered by the infeed chute to the space between the rotary wheels always are centered between the wheels, regardless of their diameter.

From the foregoing, it will be appreciated that the adjustable ball projecting device described hereinbefore provides simplified and economical means by which to accommodate the throwing of balls of different diameters, by a simple but precise simultaneous adjustment of the spacing between a pair of ball projecting wheels and the width of a ball infeed chute associated therewith, while maintaining the balls delivered to the wheels properly centered between them.

It will be apparent to those skilled in the art that various changes may be made in the size, shape, type, number and arrangement of parts described hereinbefore. For example, the wheels may take the form of elongated conveyor belts with elongated ball-engaging surfaces confronting each other. One of the wheels may be replaced with a stationary pad having a ball-engaging surface confronting the wheel surface, as in applicant's prior U.S. Pat. No. 4,080,950. Thus, lateral spacings and lateral adjustments as described and claimed herein are intended to include those spacings and adjustments regardless of whether the wheel or other ball projecting assemblies are disposed in a vertical plane, as in U.S. Pat. No. 4,080,950 or in horizontal or intermediate planes as in U.S. Pat. No. 3,774,584. Both wheels may be adjusted laterally. The coupling between each wheel and its associated feed chute segment may be made adjustable so as to vary the lateral position of each segment relative to its associated wheel. These and other changes may be made without departing from the spirit of this invention.

Having now described my invention and the manner in which it may be used, I claim:

1. A ball projecting device, comprising:

(a) a base member, (b) a pair of ball projecting members having confronting ball-engaging surfaces spaced apart laterally for gripping a ball between them, at least one of said members being driven for moving its ball-engaging surface in a ball projecting direction, (c) mounting means interengaging the base member and ball projecting members for lateral adjustment of at least one of said members relative to the other for varying the spacing between said confronting surfaces, (d) a ball feed chute including a pair of laterally disposed separate segments, and (e) coupling means connecting said lateral segments each with a different one of said ball projecting members for varying the width of the feed chute simultaneously with varying the spacing between said confronting surfaces.

2. The ball projecting device of claim 1 wherein the coupling means connecting one of the lateral segments of the feed chute with its associated ball projecting member includes adjustment means for moving the lateral segment laterally relative to its associated ball projecting member.

3. The ball projecting device of claim 1 wherein the mounting means comprises attaching means for securing one of said ball projecting members on the base member against lateral displacement, and adjusting means for securing the other of said ball projecting members on the base member for lateral adjustment relative to the said one ball projecting member for varying the spacing between said confronting surfaces.

4. The ball projecting device of claim 3 wherein the coupling means comprises securing means for securing one of the lateral segments on the base member against lateral displacement, and connector means interconnecting the other of said lateral segments and the said other ball projecting member for simultaneous lateral adjustment thereof.

5. The ball projecting device of claim 4 wherein the connector means includes adjustment means for moving the said other lateral segment laterally relative to its associated ball projecting member.

* * * * *